US007173593B2

(12) United States Patent
Matsumura et al.

(10) Patent No.: US 7,173,593 B2
(45) Date of Patent: Feb. 6, 2007

(54) MEMORY CIRCUIT, DISPLAY CIRCUIT, AND DISPLAY DEVICE

(75) Inventors: Masakiyo Matsumura, Yokohama (JP); Takahiro Korenari, Yokohama (JP)

(73) Assignee: Advanced LCD Technologies Development Center Co., Ltd., Yokohama (JP)

( * ) Notice: Subject to any disclaimer, the term of this patent is extended or adjusted under 35 U.S.C. 154(b) by 575 days.

(21) Appl. No.: 10/662,531

(22) Filed: Sep. 16, 2003

(65) Prior Publication Data

US 2004/0070560 A1 Apr. 15, 2004

(30) Foreign Application Priority Data

Sep. 17, 2002 (JP) ..... 2002-270665

(51) Int. Cl.
*G09G 3/36* (2006.01)

(52) U.S. Cl. ..... 345/98; 345/87

(58) Field of Classification Search ..... 345/87, 345/90, 92, 98, 100, 204
See application file for complete search history.

(56) References Cited

U.S. PATENT DOCUMENTS

| | | | | |
|---|---|---|---|---|
| 6,072,454 | A * | 6/2000 | Nakai et al. | 345/97 |
| 6,249,269 | B1 * | 6/2001 | Blalock et al. | 345/97 |
| 6,600,472 | B1 * | 7/2003 | Nakai et al. | 345/91 |
| 7,027,026 | B2 * | 4/2006 | Tsutsui | 345/98 |
| 7,042,426 | B2 * | 5/2006 | Shin | 345/76 |
| 7,053,890 | B2 * | 5/2006 | Inukai | 345/211 |
| 2005/0030264 | A1 * | 2/2005 | Tsuge et al. | 345/76 |
| 2005/0041002 | A1 * | 2/2005 | Takahara et al. | 345/76 |

FOREIGN PATENT DOCUMENTS

| | | |
|---|---|---|
| JP | 6-235902 | 8/1994 |
| JP | 2000-293144 | 10/2000 |
| JP | 2002-23705 | 1/2002 |
| JP | 2002-366116 | 12/2002 |
| JP | 2002-366117 | 12/2002 |
| WO | WO 97/05596 | 2/1997 |

* cited by examiner

*Primary Examiner*—Ricardo Osorio
(74) *Attorney, Agent, or Firm*—Oblon, Spivak, McClelland, Maier & Neustadt, P.C.

(57) ABSTRACT

A liquid crystal display includes pixels arrayed in a matrix of rows and columns, scanning lines extending along the rows of the pixels, signal lines extending along the columns of the pixels, and pixel driving sections which are disposed near intersections of the scanning lines and signal lines, and each of which is controlled via one scanning line to capture a data signal on one signal line and output the data signal to one pixel. Particularly, each pixel driving section includes a memory circuit having a transistor whose gate is connected to the one signal line, and first and second storage capacitances which are charged to positive and negative power supply voltages and connected to a source and drain of the transistor to store the data signal as analog drive voltages of positive and negative polarities, respectively.

23 Claims, 5 Drawing Sheets

MEMORY CIRCUIT, DISPLAY CIRCUIT, AND DISPLAY DEVICE

CROSS-REFERENCE TO RELATED APPLICATIONS

This application is based upon and claims the benefit of priority from the prior Japanese Patent Application No. 2002-270665, filed Sep. 17, 2002, the entire contents of which are incorporated herein by reference.

BACKGROUND OF THE INVENTION

1. Field of the Invention

The present invention generally relates to a display device, such as a liquid crystal display device or EL (Electro Luminescence) display device, and more particularly to a memory circuit, display circuit, and display device arranged to store a data signal for a pixel, for example.

2. Description of the Related Art

In the liquid crystal display device, a large number of pixels are arrayed in a matrix of rows and columns so as to display an image corresponding to one frame of a video signal input from an external signal source such as a personal computer. The video signal is serial-parallel converted into data signals to be applied as analog drive voltages to the pixels in each row. When the video signal is in digital form, a digital-to-analog converter (DAC) is used to obtain the data signals. These data signals are applied via signal lines to the pixels in each row. A capacitance of each pixel is charged or discharged by the analog drive voltage of the data signal, and holds the drive voltage as a charge until update of the data signal.

The data signal is normally updated for each frame period and then transferred to the pixel via the signal line. Such frequent transfer of the data signal makes it difficult to keep power dissipation low. All the data signals do not need to be transferred to the pixels every frame period, for example, in still image display, or even in moving image display where the luminance of all the pixels is maintained between adjacent frames. Thus, to reduce the frequency of transferring the data signals, a technique has been proposed in which pixel memories for storing drive voltages over a long period of time are added to the pixels so that the data signals can be updated only when there arises the need of changing the luminance or there arises the need of reversing the polarity of the drive voltages without changing the luminance. However, the conventional pixel memory is generally of one bit. Thus, intermediate gradations cannot be obtained for displaying a full-color image.

The intermediate gradations are obtainable if the pixel memory is associated with the following configurations:

(1) Configuring the pixel memory for each pixel to store two or more bits of data and attaching an analog-to-digital converter(ADC) and a DAC to the pixel memory.

(2) Forming each pixel to have two or more subpixels and changing the ratio of the white display area.

(3) Performing time-division modulation on each pixel and changing the rate of the white display period.

It is difficult to realize the configurations (1) and (2) in a small pixel size. With the configuration (3), many problems are encountered in increasing gradations. For instance, flicker is liable to occur. To solve these, the pixel memory is simply configured so that it can hold an analog drive voltage.

In general, it is possible to hold an arbitrary analog drive voltage by the use of a capacitance. In introducing this capacitance into a pixel, there is the need for such a circuit arrangement as outputs an analog drive voltage without canceling charges on the capacitance. With the liquid crystal display device, the application of a voltage of one polarity to the liquid crystal layer over a long period of time causes the quality of the liquid crystal material to suffer. For instance, the resistivity of the liquid crystal material decreases. Thus, polarity inversion driving is required from the point of view of liquid crystal life span. Accordingly, it is desirable to additionally hold a voltage (−Vdata) opposite in polarity to a voltage (+Vdata) of the data signal from the signal line, and apply these voltages alternately to the pixel electrode on successive frames.

BRIEF SUMMARY OF THE INVENTION

An object of the present invention is to provide a memory circuit, display circuit and display device which can store a data signal as analog drive voltages of positive and negative polarities.

According to a first aspect of the invention, there is provided a memory circuit comprising: a transistor whose gate is connected to input a data signal; and first and second storage capacitances which are charged to positive and negative power supply voltages and connected to a source and drain of the transistor to store the data signal as analog drive voltages of positive and negative polarities, respectively.

According to a second aspect of the invention, there is provided a display circuit comprising: a liquid crystal display element having a structure that liquid crystal materials are held between a pair of electrodes; a memory circuit having a transistor whose gate is connected to input a data signal, and first and second storage capacitances which are charged to positive and negative power supply voltages and connected to a source and drain of the transistor to store the data signal as analog drive voltages of positive and negative polarities, respectively; and an output circuit which alternately applies the analog drive voltages of the positive and negative polarities held by the first and second storage capacitances to the liquid crystal display element.

According to a third aspect of the present invention, there is provided a display device comprising: a plurality of pixels arrayed in a matrix of rows and columns; a plurality of scanning lines extending along the rows of the pixels; a plurality of signal lines extending along the columns of the pixels; and a plurality of pixel driving sections which are disposed near intersections of the scanning and signal lines, and each of which is controlled via one scanning line to capture a data signal on one signal line and output the data signal to one pixel, each pixel driving section including a memory circuit having a transistor whose gate is connected to the one signal line, and first and second storage capacitances which are charged to positive and negative power supply voltages and connected to a source and drain of the transistor to store the data signal as analog drive voltages of positive and negative polarities, respectively.

With the memory circuit, display circuit, and display device, when the source and drain of the transistor are connected to the first and second storage capacitances, the charges in the first and second storage capacitances are redistributed to provide the data signal as the analog drive voltages of the positive and negative polarities. These analog drive voltages are continuously held by the first and second storage capacitances while the data signal does not need to be updated. Thus, intermediate gradations can be obtained in display even if update of the data signal is suspended to reduce power dissipation. In addition, when the pixel is a liquid crystal pixel, the polarity of the voltage across the pixel is easily inverted by alternately outputting the analog drive voltages of the positive and negative polarities held by the first and second storage capacitances. Accordingly, degradation of liquid crystal materials can be prevented.

BRIEF DESCRIPTION OF THE SEVERAL VIEWS OF THE DRAWING

The accompanying drawings, which are incorporated in and constitute a part of the specification, illustrates an embodiment of the invention, and together with the general description given above and the detailed description of the embodiment given below, serve to explain the principles of the invention.

DETAILED DESCRIPTION OF THE INVENTION

A liquid crystal display device according to an embodiment of the present invention will now be described with reference to the accompanying drawings.

Figure 1:
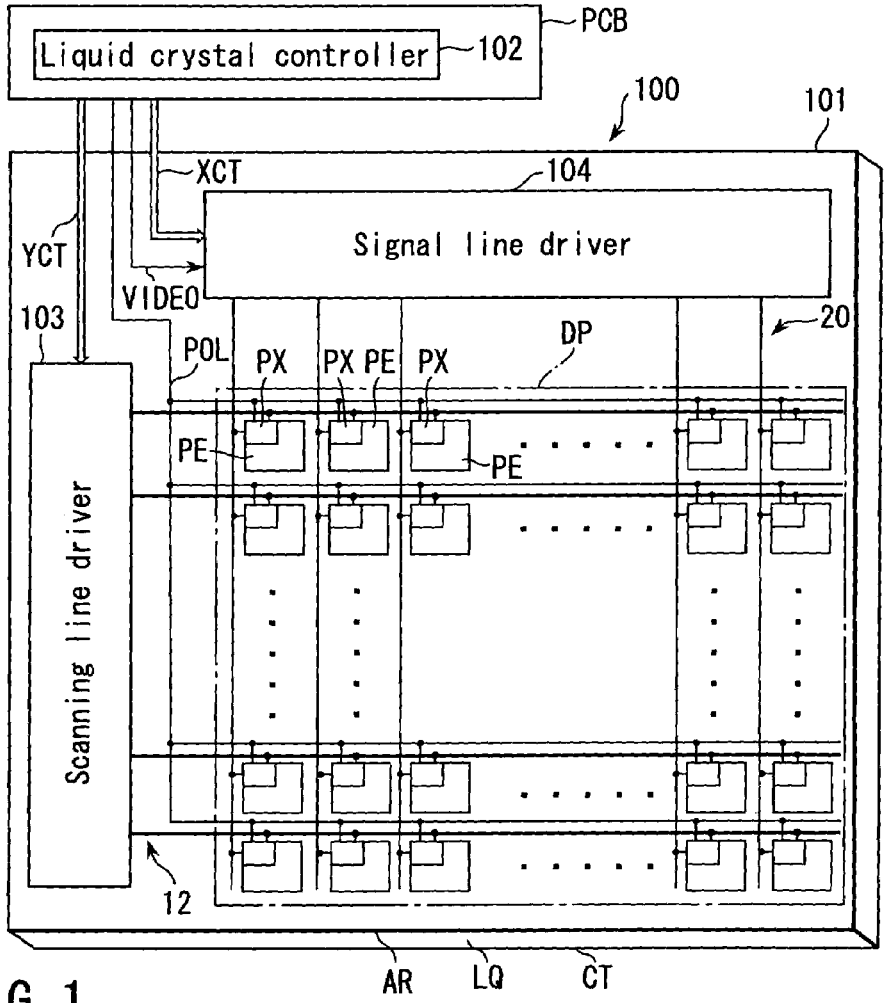
FIG. 1 is a diagram showing a schematic circuit configuration of a liquid crystal display device according to an embodiment of the present invention.
Figure 2:
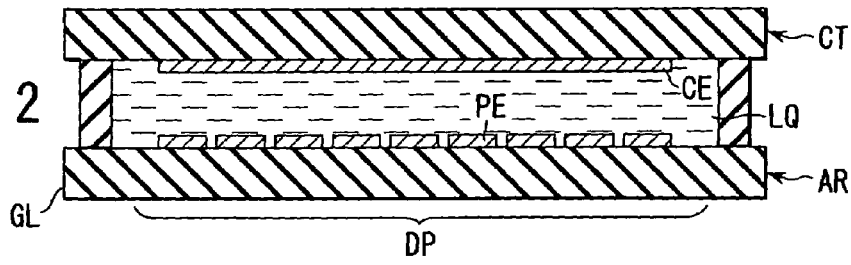
FIG. 2 is a diagram showing a schematic sectional structure of the liquid crystal display device shown in FIG. 1.

FIG. 1 shows a schematic circuit configuration of the liquid crystal display device 100, and FIG. 2 shows a schematic sectional structure of the liquid crystal display device 100.

The liquid crystal display device 100 includes a liquid crystal display panel 101 and a liquid crystal controller 102 for controlling the liquid crystal display panel 101. The liquid crystal display panel 101 has a structure that a liquid crystal layer LQ is held between an array substrate AR and a counter substrate CT. The liquid crystal controller 102 is disposed on a drive circuit board PCB provided independently of the liquid crystal display panel 101.

The array substrate AR includes a plurality of pixel electrodes PE arrayed in a matrix of rows and columns within a display area DP on a glass plate GL, a plurality of scanning lines 12 extending along the rows of the pixel electrodes PE, a plurality of signal lines 20 extending along the columns of the pixel electrodes PE, a plurality of pixel driving sections PX which are disposed near intersections of the scanning lines 12 and signal lines 20, respectively, and each of which captures a voltage Vdata of a data signal from a corresponding signal line 20 in response to a scanning signal supplied from a corresponding scanning line 12 and outputs the data signal voltage Vdata to a corresponding pixel electrode PE, a scanning line driver 103 for driving the scanning lines 12, and a signal line driver 104 for driving the signal lines 20.

The counter substrate CT includes a single counter electrode CE, which is disposed to face the pixel electrodes PE and set at ground potential GND, color filters not shown, and other components.

The liquid crystal controller 102 receives a digital video signal VIDEO and sync signals from outside to generate a vertical scan control signal YCT, a horizontal scan control signal XCT, a polarity control signal POL, and the like. The vertical scan control signal YCT is supplied to the scanning line driver 103. The horizontal scan control signal XCT is supplied to the signal line driver 104 together with the video signal VIDEO. The polarity control signal POL is supplied to each of the pixel driving sections PX.

The scanning line driver 103 is controlled by the vertical scan control signal YCT to sequentially supply scanning signals of positive and negative polarities to the scanning lines 12 in each vertical scanning (frame) period, for example. The scanning signals of the positive and negative polarities are supplied to each of the scanning lines 12 only for one horizontal line period (1H).

The signal line driver 104 is controlled by the horizontal scan control signal XCT to perform serial-parallel conversion and digital-to-analog conversion on the video signal VIDEO input in each horizontal scanning period, during which one scanning line is driven, and supply data signals Vdata for the pixels in one row to the signal lines 20.

Figure 3:
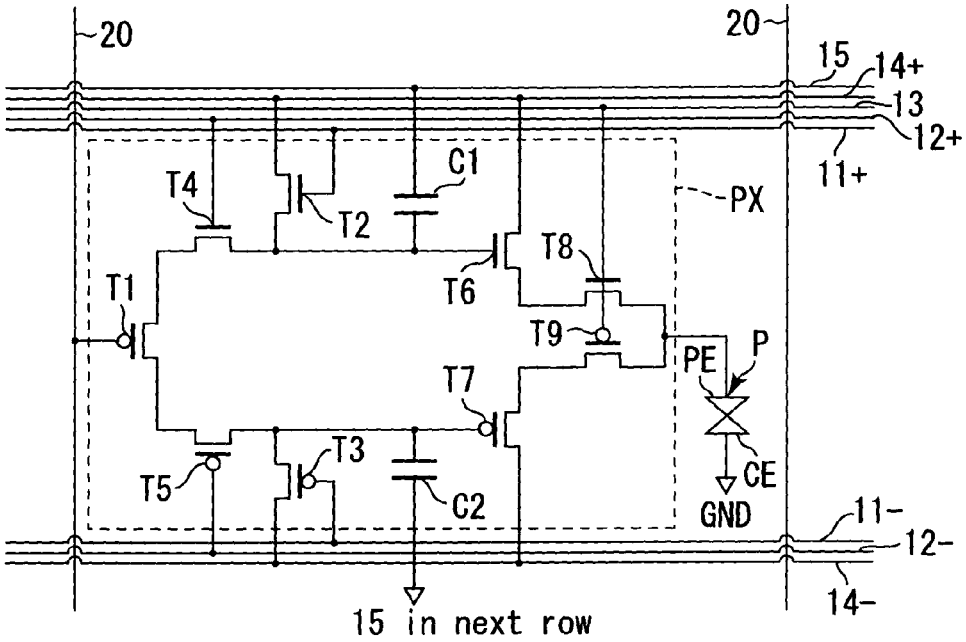
FIG. 3 is a diagram showing an equivalent circuit of the pixel display section shown in FIG. 1.

FIG. 3 shows an equivalent circuit of each pixel driving section PX shown in FIG. 1. In FIG. 3, P denotes a pixel formed of one pixel electrode PE, the counter electrode CE, and liquid crystal materials in the liquid crystal layer LQ held between the electrodes PE and CE. Each pixel driving section PX includes a memory circuit for storing the data signal for one pixel (P) as analog drive voltages of positive and negative polarities. On the array substrate AR, each scanning line 12 includes first subscanning lines 11+ and 11− of positive and negative polarities and second subscanning lines 12+ and 12− of positive and negative polarities, which are arranged in parallel and extend in the row direction. In addition, a polarity control line 13, power lines 14+ and 14− of positive and negative polarities and a ground line 15 are arranged in parallel and extend in the row direction.

The memory circuit includes two power supplies of positive and negative polarities, and transistors T1 to T9, and first and second storage capacitances C1 and C2 are associated with each other, and is connected to the pixel electrode PE serving as a load. In FIG. 3, T1, T3, T7 and T9 are P-channel transistors, whereas T2, T4, T6 and T8 are N-channel transistors. In the memory circuit, transistors T2 to T5 are configured to form a switch circuit which connects the first and second storage capacitances C1 and C2 to the power lines 14+ and 14− of the positive and negative polarities for supplying positive and negative power supply voltages, respectively, and then connects the first and second storage capacitances C1 and C2 to the source and drain of the transistor T1, respectively. Further, the transistors T6 to T9 are configured to form an output circuit which outputs the analog drive voltage of the positive polarity held by the first storage capacitance C1 and the analog drive voltage of the negative polarity held by the second storage capacitance C2.

The gates of the transistors T1 to T5 are connected to the signal line 20, the signal line 20, the first subscanning line 11+, the first subscanning line 11−, the second subscanning line 12+, the second subscanning line 12−, respectively. The source of the transistor T2 is connected to the power line 14+, and the drain of the transistor T2 is connected to the first storage capacitance C1 and the source of the transistor T4. The drain of the transistor T3 is connected to the power line 14−, and the source of the transistor T3 is connected to the storage capacitance C2 and the drain of the transistor T5. The storage capacitances C1 and C2 have their grounding terminals connected to the ground line 15 and the ground line in the next row, respectively. The source and drain of the transistor T1 are connected to the drain of the transistor T4 and the source of the transistor T5, respectively. The gates of the transistors T6 and T7 are connected to the first storage capacitances C1, the second storage capacitance C2, respectively. The gates of the transistors T8 and T9 are connected together to the polarity control line 13. The source and drain of the transistor T6 are connected to the power line 14+ and the source of the transistor T8, respectively. The drain of the transistor T8 is connected to the pixel electrode PE. The source and drain of the transistor T7 are connected to the power line 14− and the drain of the transistor T9, respectively. The source of the transistor T9 is connected to the pixel electrode PE.

Figure 4:
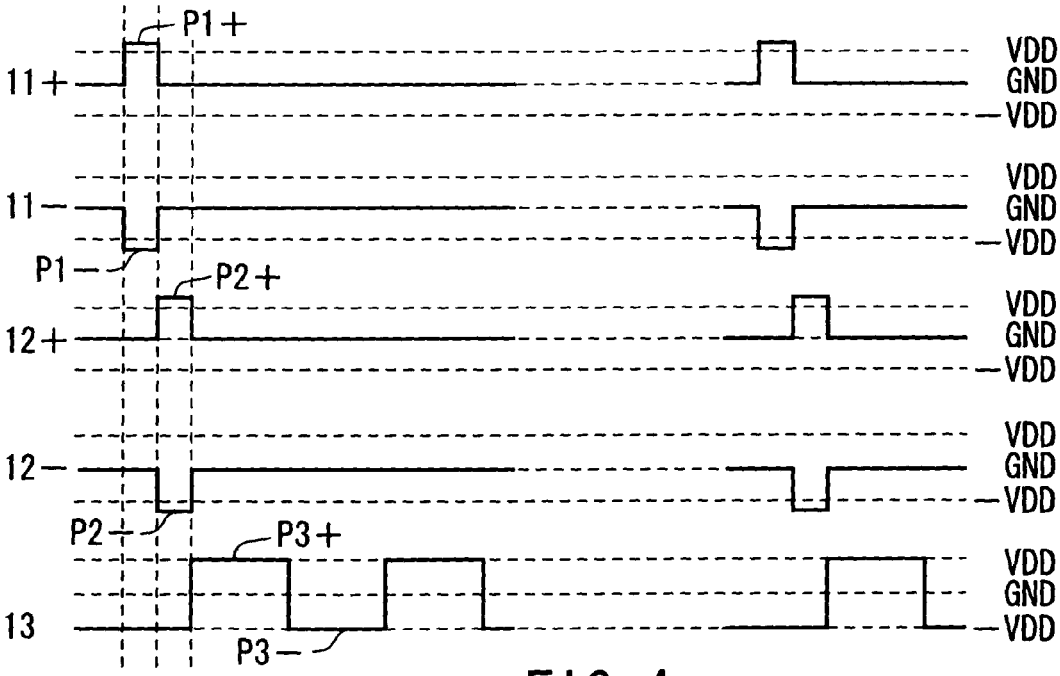
FIG. 4 is a timing chart for explaining the operation of the pixel driving section shown in FIG. 3.

The operation of the pixel driving section PX thus configured will be described below with reference to a timing chart shown in FIG. 4. In the display panel 101, positive and negative pulses P1+ and P1− are initially applied to the gates of the transistors T2 and T3 via the first subscanning lines 11+ and 11−, respectively, during the horizontal scanning period for the previous row, so that the transistors T2 and T3 are both turned ON. Thereby, the first and second storage capacitances C1 and C2 are connected to the power lines 14+ and 14−, respectively, with the result that C1 and C2 are charged to positive and negative initial voltages +Vpi and −Vmi, respectively.

When the voltages applied to the gates of the transistors T2 and T3 are identical to the power supply voltages +VDD and −VDD, respectively, their gate-to-source voltages become 0 volts, resulting in saturation currents flowing at their drains. As the result, the initial voltages +Vpi and −Vmi of the first and second storage capacitances C1 and C2 will be reduced by the threshold voltages of T2 and T3, respectively, so that +Vpi=+VDD−VTn and −Vmi=−VDD+VTp. In order to maintain initial voltages +Vpi=+VDD and −Vmi=−VDD of the storage capacitances C1 and C2, respectively, it is required that the voltages applied to the gates of T2 and T3 be not less than +VDD+VTn and −VDD−VTp, respectively. Here, VTn is the threshold voltage of N-channel transistors and VTp is the threshold voltage of P-channel transistors. In the case of an N-channel transistor, it is turned ON by setting its gate potential higher than its source potential. On the other hand, a P-channel transistor is turned ON by setting its gate potential lower than its source potential. For this reason, the transistors T2 and T3 will be turned ON by setting their gate voltages to not less than +VDD+VTn and −VDD−VTp, respectively. However, since the gate potentials of the transistors at the time are higher and lower than the source potentials thereof, respectively, the source potentials of the transistors will go higher and lower than the gate potentials thereof, respectively. However, since the source potentials will not exceed the power supply voltages, the initial voltages at this time will be +Vpi=+VDD and −Vmi=−VDD. When the pulses P1+ and P1− are reset to 0 volts, the transistors T2 and T3 are turned OFF, so that charges in the first and second storage capacitances C1 and C2 become unable to escape anywhere. Thus, the initial voltages +Vpi and −Vmi at the moment that the pulses P1+ and P1− are reset are held by the first and second storage capacitances C1 and C2. In practice, the initial voltages of C1 and C2 will change gradually due to leakage current in the transistors T2 and T3 and the first and second storage capacitances C1 and C2.

Next, positive and negative pulses P2+ and P2− are applied to the gates of the transistors T4 and T5 via the second subscanning lines 12+ and 12−, respectively, during the horizontal scanning period for a specified row, so as to turn ON the transistors T4 and T5. At this time, a data signal voltage +Vdata is simultaneously applied to the gate of the transistor T1 via the signal line 20. As the result, the first and second storage capacitances C1 and C2 are connected to the source and the drain of the transistor T1 to supply the initial voltages +Vpi and −Vmi. At this time, positive and negative voltages +Vp and −Vm are held by the first and second drive capacitances C1 and C2, respectively.

When the data signal voltage +Vdata is applied to the gate of the transistor T1 whose source and drain are respectively set to the initial voltages +Vpi and −Vmi, the source potential goes higher than the gate potential by the threshold voltage VTp of the transistor T1. Since the drain potential is opposite in phase to the source potential, the drive voltages at this time becomes +Vp=+Vdata+VTp and −Vm=−Vdata−VTp+Vpi−Vmi. When the pulses P2+ and P2− are reset to 0 volts, the transistors T4 and T5 are turned OFF. Thus, the drive voltages +Vp and −Vm at the moment the pulses P2+ and P2− are reset to 0 volts are held by the first and second storage capacitances C1 and C2. At the same time, the transistor T1 is isolated to interrupting subsequent data entry from the signal line 20.

When the initial voltages are less than the power supply voltages, i.e., +Vpi=+VDD−VTn and −Vmi=−VDD+VTp, the drive voltages +Vp and −Vm become +Vp=+Vdata+VTp and −Vm=−Vdata−VTp+Vpi−Vmi=−Vdata−VTp+VDD−VTn−VDD+VTp=−Vdata−VTn.

When the initial voltages are equal to the power supply voltages, i.e., +Vpi=+VDD and −Vmi=−VDD, the drive voltages +Vp and −Vm become +Vp=+Vdata+VTp and −Vm=−Vdata−VTp+Vpi−Vmi=−Vdata−VTp+VDD−VDD=−Vdata−VTp.

Thus, the drive voltages +Vp and −Vm vary with the initial voltages +Vpi and −Vmi. When the threshold voltages VTn and VTp of the N- and P-channel transistors are equal to each other in absolute value, no problem arises. If the threshold voltages differ from each other, countermeasures of compensating for the difference are required. In order to set the drive voltages held by the first and second storage capacitances C1 and C2 equal in magnitude to the data voltage (i.e., +Vp=+Vdata and −Vm=−Vdata), a voltage which is less than +Vdata by the threshold voltage VTp, i.e., +Vdata−VTp, is simply applied to the gate of the transistor T1. When an N-channel transistor is used as the transistor T1, application of a negative data voltage −Vdata to its gate will result in the same effects as when a P-channel transistor is used.

The drive voltages +Vp and −Vm held by the first and second storage capacitances C1 and C2 are respectively applied to the gates of the transistors T6 and T7 and then transferred or read to the source of the transistor T8 and the drain of the transistor T9 without being destroyed. Each of the transistors T6 and T7 serves as an amplifier having a voltage gain of 1. The source potential follows the gate potential with a constant difference therebetween.

As described previously, when +Vpi=+VDD and −Vmi=−VDD, the drive voltages held by the first and second storage capacitances C1 and C2 become +Vp=+Vdata+VTp and −Vm=−Vdata−VTp. These drive voltages drop by the threshold voltages VTn and VTp of the respective transistors T6 and T7, so that +Vp=+Vdata+VTp−VTn and −Vm=−Vdata−VTp+VTp=−Vdata. Therefore, designing N- and P-channel transistors such that VTn=VTp will result in +Vp=+Vdata and −Vm=−Vdata. That is, positive and negative drive voltages which are equal in absolute value to the data signal voltage are obtained.

Next, positive and negative pulses P3+ and P3− are alternately applied to the gates of the transistors T8 and T9 via the polarity control line 13, with one pulse in each frame. When the positive pulse P3+ is applied to the gates of the transistors T8 and T9, the transistor T8 is turned ON, while the transistor T9 is turned OFF. Thereby, a circuit of the first storage capacitance C1 and the transistor T6 is connected to the pixel electrode PE, so that the positive drive voltage +Vp held by the first storage capacitance C1 is read through the transistor T6 onto the pixel electrode PE. On the other hand, when the negative pulse P3− is applied to the gates of the transistors T8 and T9, the transistor T8 is turned OFF, while the transistor T9 is turned ON. Thereby, a circuit of the storage capacitance C2 and the transistor T7 is connected to the pixel electrode PE, so that the negative drive voltage −Vm held by the second storage the capacitance C2 is read through the transistor T7 onto the pixel electrode PE. Thus, the positive and negative drive voltages +Vp and −Vm are alternately applied to the pixel electrode PE as a voltage whose polarity is inverted for each frame to achieve inversion driving of the voltage between the pixel electrode PE and the counter electrode CE.

As described previously, when N- and P-channel transistors are designed so that their threshold voltages are equal to each other, i.e., VTn=VTp, positive and negative drive voltages which are equal in absolute value to data signal voltage are obtained, i.e., +Vp=+Vdata and −Vm=−Vdata.

Figure 5:
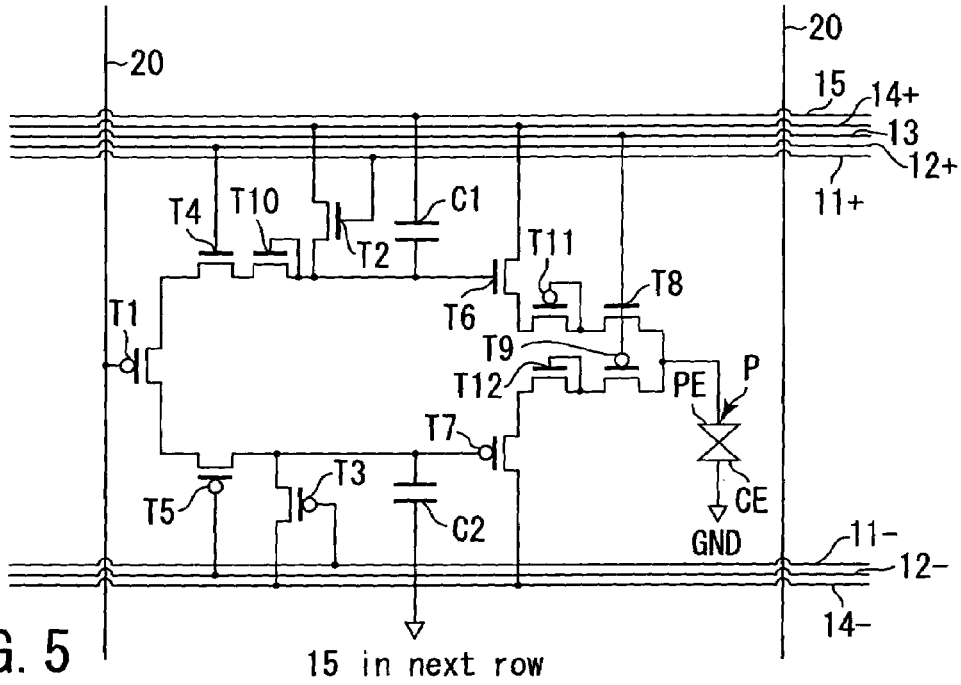
FIG. 5 is a diagram showing a first modification of the pixel driving section of FIG. 3 in which voltage dropping transistors are added.

FIG. 5 shows an equivalent circuit of the first modification of the pixel driving section PX shown in FIG. 3. The same reference symbols are attached to parts similar to those shown in FIG. 3, and redundant explanations are omitted for simplicity. When the threshold voltages VTn and VTp of N- and P-channel transistors differ from each other, a circuit of N-channel transistors T10 and T12 and a circuit of a P-channel transistor T11 are additionally connected to the circuit configured as shown in FIG. 3 as shown in FIG. 5 so as to obtain the same effects as when the threshold voltages are equal to each other. The source of the transistor T10 is connected to the drain of the transistor T4, the gate and drain of the transistor T10 are connected to the drain of the transistor T2. The source of the transistor T12 is connected to the drain of the transistor T7, and the gate and drain of the transistor T12 are connected to the drain of the transistor T9. The source of the transistor T11 is connected to the source of the transistor T6, and the gate and drain of the transistor T11 are connected to the source of the transistor T8.

That is, voltages which exceed than the power supply voltages by the threshold voltages or more are applied to the gates of the transistors T2 and T3 to turn ON and OFF the transistors T4 and T5 in a state where the initial voltages, +Vpi=+VDD and −Vmi=−VDD, are held by the first and second storage capacitances C1 and C2, the potential at the succeeding stage of the N-channel transistor T10 increases by the threshold voltage VTn, allowing the storage capacitances Cl and C2 to hold drive voltages +Vp=+Vdata+VTp+VTn and −Vm=−Vdata−VTp−VTn.

Next, the drive voltages +Vp and −Vm at the succeeding stages of the N- and P-channel transistors T6 and T7 drop by the threshold voltages VTn and VTp, respectively, resulting in +Vp=+Vdata+VTp and −Vm=−Vdata−VTn.

Next, the drive voltages +Vp and −Vm at the succeeding stages of the N- and P-channel transistors T11 and T12 drop by the threshold voltages VTn and VTp, respectively, resulting in +Vp=+Vdata and −Vm=−Vdata. Thus, the positive and negative drive voltages equal in absolute value to the data voltage are obtained.

Figure 6:
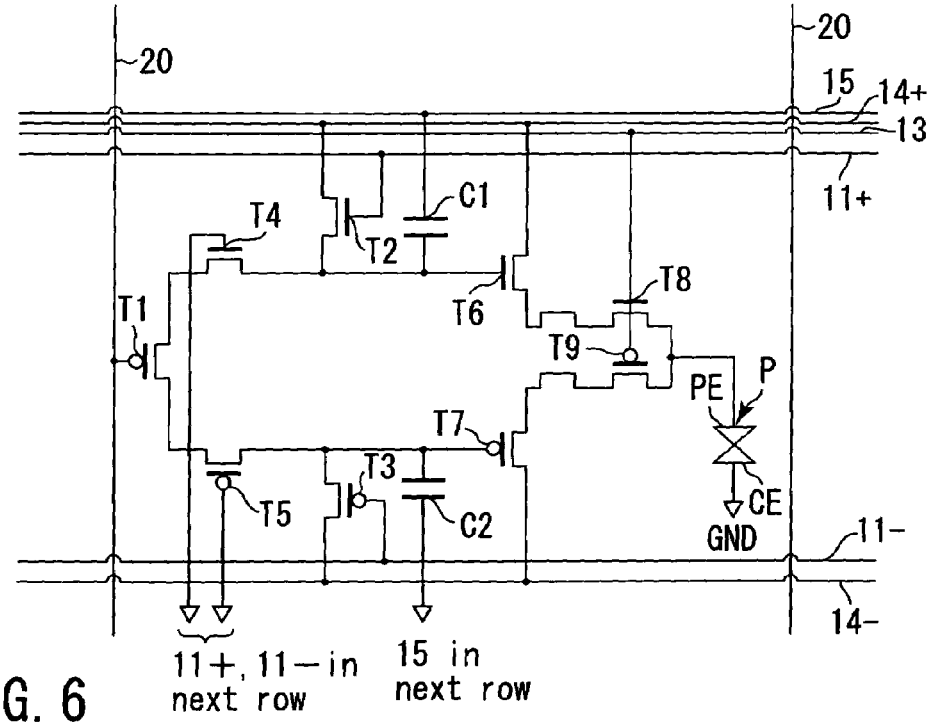
FIG. 6 is a diagram showing a second modification of the pixel driving section of FIG. 3 in which second subscanning lines are eliminated.

The display panel 101 requires a large number of wiring lines extending in the horizontal scanning direction, which include the first subscanning lines 11+ and 11−, the second subscanning lines 12+ and 12−, the polarity control line 13, the power lines 14+ and 14−, and the ground lines 15. When it is difficult to provide these wiring lines, the number of lines will be reduced by the following modifications:

Second Modification:

FIG. 6 shows the second modification of the pixel driving section shown in FIG. 3. The same reference symbols are attached to parts similar to those shown in FIG. 3, and redundant explanations are omitted for simplicity. The pulses P2+ and P2− may be applied to the lines for scanning a specified row at the same timing as that of the pulses P1+ and P1− applied to the lines for scanning the next row. Therefore, as shown in FIG. 6, the first subscanning lines 11+ and 11− for the next row are substituted for the second subscanning lines 12+ and 12− connected to the gates of the transistors T4 and T5, so that the second subscanning lines 12+ and 12− can be eliminated.

Figure 7:
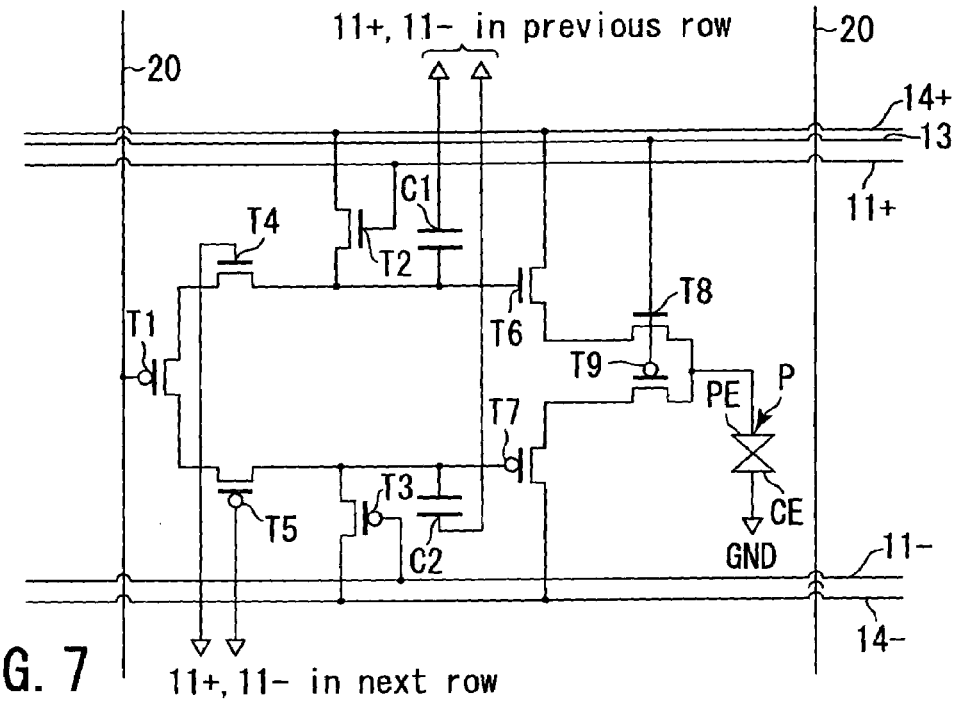
FIG. 7 is a diagram showing a third modification of the pixel driving section of FIG. 3 in which ground lines are eliminated.

Third Modification:

FIG. 7 shows the third modification of the pixel driving section shown in FIG. 3. The same reference symbols are attached to parts similar to those shown in FIG. 3, and redundant explanations are omitted for simplicity. The first subscanning lines 11+ and 11− for the previous row remain unused until the next data signal for the pixel arrives. Therefore, as shown in FIG. 7, the first subscanning lines 11+ and 11− for the previous row are substituted for the ground lines 15 grounding the first and second storage capacitances C1 and C2, so that the ground lines 15 can be eliminated.

Figure 8:
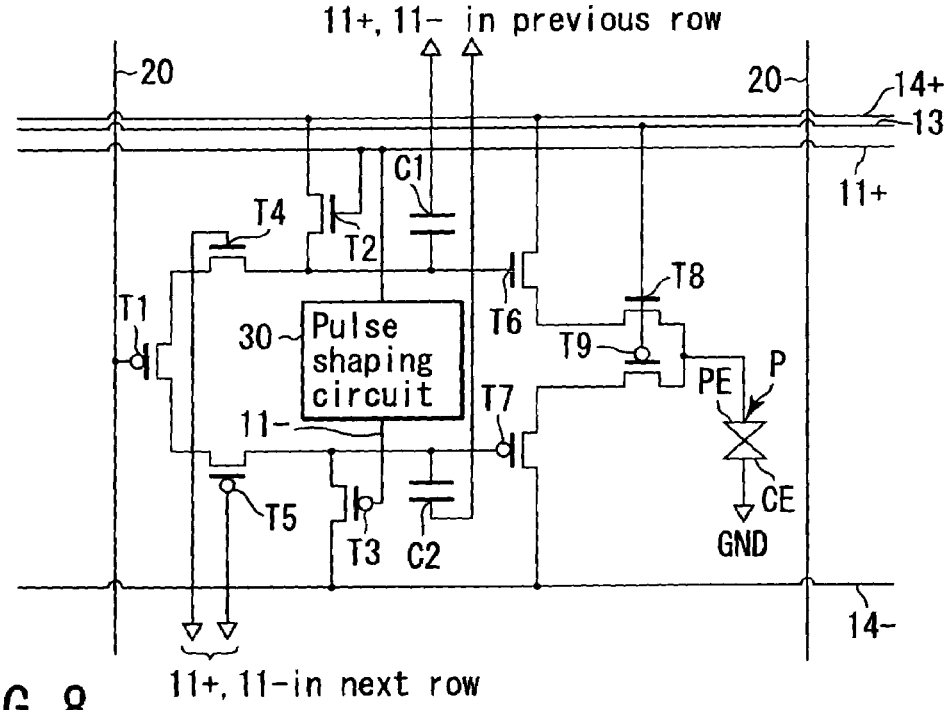
FIG. 8 is a diagram showing a fourth modification of the pixel driving section of FIG. 3 in which a first subscanning line of a negative polarity is eliminated.

Fourth Modification:

FIG. 8 shows the fourth modification of the pixel driving section shown in FIG. 3. The same reference symbols are attached to parts similar to those shown in FIG. 3, and redundant explanations are omitted for simplicity. As shown in FIG. 8, a pulse shaping circuit 30 is provided which is formed in a combination of an inverter circuit for inverting the positive pulse P1+ to the negative pulse P1− and a clamp circuit. Therefore, the output line 11'− of the pulse shaping circuit 30 is substituted for the first subscanning line 11− connected to the gate of the transistor T3, so that the first subscanning line 11− can be eliminated.

Figure 9:
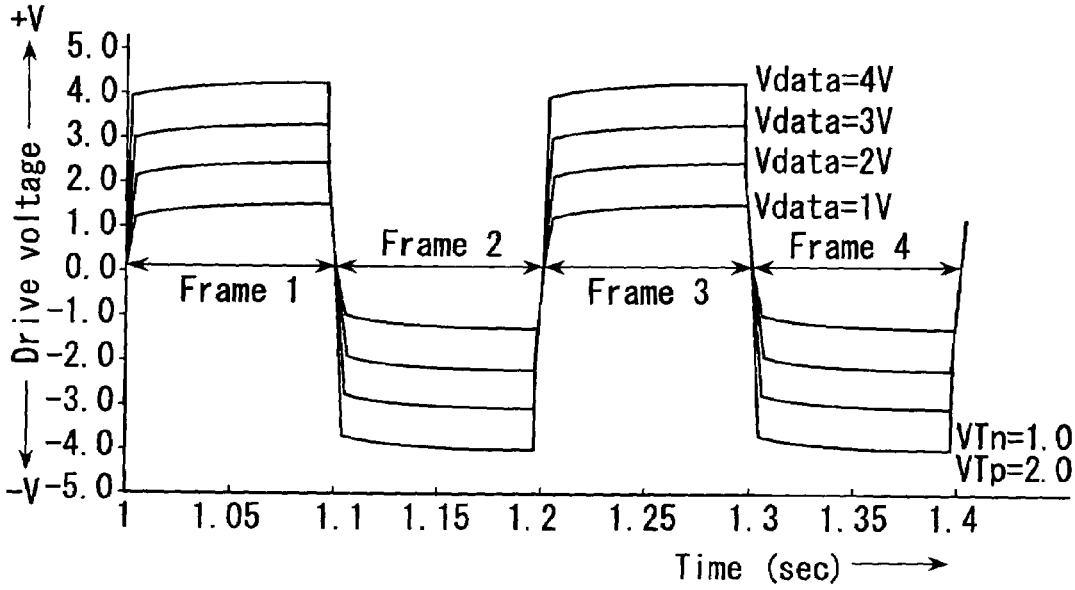
FIG. 9 is a diagram showing drive voltage waveforms obtained from a circuit simulator that simulates the circuit configuration shown in FIG. 3.

Drive voltage waveforms shown in FIG. 9 are obtained from a circuit simulator which simulates the circuit configuration of FIG. 3. As can be seen from FIG. 9, even in the case where the threshold voltages VTn and VTp of N- and P-channel transistors differ from each other, i.e., VTn=1.0 V and VTp=−2.0 V, positive and negative drive voltages +Vp=+Vdata and −Vm=−Vdata, equal in absolute value to the data signal voltage +Vdata supplied to the gate of the transistor T1, are alternately output on successive frames (that is, the positive drive voltage +Vp is output on odd-numbered frames and the negative drive voltage −Vm is output on even-numbered frames).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A memory circuit comprising:

a transistor whose gate is connected to input a data signal; and first and second storage capacitances which are charged to positive and negative power supply voltages and connected to a source and drain of said transistor to store the data signal as analog drive voltages of positive and negative polarities, respectively.

2. The memory circuit according to claim 1, further comprising a switch circuit which initially connects said first and second storage capacitances to power lines of the positive and negative polarities which supply the positive and negative power supply voltages, respectively, and then connects said first and second storage capacitances to the source and drain of said transistor, respectively.

3. The memory circuit according to claim 2, further comprising an output circuit which outputs the analog drive voltages of the positive and negative polarities held by said first and second storage capacitances.

4. The memory circuit according to claim 3, wherein said switch circuit includes a second transistor connected between said power line of the positive polarity and said first storage capacitance, a third transistor connected between said power line of the negative polarity and said second storage capacitance, a fourth transistor connected between the source of said first transistor and said first storage capacitance, a fifth transistor connected between said the drain of said first transistor and said second storage capacitance, said second and third transistors are controlled to temporarily turn on for setting said first and second storage capacitances to the positive and negative power supply voltages, respectively, and said fourth and fifth transistors are controlled to temporarily turn on, in place of said second and third transistors, for causing said first and second storage capacitances to store the data signal as the analog drive voltages of the positive and negative polarities, respectively.

5. The memory circuit according to claim 4, wherein said output circuit includes sixth and seventh transistors whose gates are connected to said first and second storage capacitances, an eighth transistor connected at one end to said power line of the positive polarity via said sixth transistor and at the other end to a first load, and a ninth transistor connected at one end to said power line of the negative polarity via said seventh transistor and at the other end to a second load, and conduction of said eighth and ninth transistors are controlled.

6. The memory circuit according to claim 5, wherein said first, third, fifth, seventh, and ninth transistors are P-channel transistors, and said second, fourth, sixth, and eighth transistors are N-channel transistors.

7. The memory circuit according to claim 6, wherein the threshold voltages of said P-channel and N-channel transistors differ from each other in absolute value, said switch circuit further includes a tenth transistor connected between said first storage capacitance and said fourth transistor, said output circuit includes an eleventh transistor connected between said sixth and eighth transistors and a twelfth transistor connected between said seventh and ninth transistors, said tenth, eleventh, twelfth transistors are N-channel, P-channel, and N-channel transistors serving as voltage drop elements which compensate for a difference in the threshold voltages to provide the drive voltages of the positive and negative polarities equal in absolute value.

8. The memory circuit according to claim 5, wherein said first and second loads are formed of a common liquid crystal display element having a structure that liquid crystal materials are held between a pair of electrodes.

9. The memory circuit according to claim 1, wherein said transistor is one of P- and N-channel transistors.

10. A display circuit comprising:

a liquid crystal display element having a structure that liquid crystal materials are held between a pair of electrodes;

a memory circuit having a transistor whose gate is connected to input a data signal, and first and second storage capacitances which are charged to positive and negative power supply voltages and connected to a source and drain of said transistor to store the data signal as analog drive voltages of positive and negative polarities, respectively; and an output circuit which alternately applies the analog drive voltages of the positive and negative polarities held by said first and second storage capacitances to said liquid crystal display element.

11. The display circuit according to claim 10, wherein said memory circuit includes a switch circuit which initially connects said first and second storage capacitances to power lines of the positive and negative polarities which supply the positive and negative power supply voltages, respectively, and then connects said first and second storage capacitances to the source and drain of said transistor, respectively.

12. A display device comprising:

a plurality of pixels arrayed in a matrix of rows and columns;

a plurality of scanning lines extending along the rows of said pixels;

a plurality of signal lines extending along the columns of said pixels; and a plurality of pixel driving sections which are disposed near intersections of said scanning and signal lines, and each of which is controlled via one scanning line to capture a data signal on one signal line and output the data signal to one pixel, each pixel driving section including a memory circuit having a transistor whose gate is connected to the one signal line, and first and second storage capacitances which are charged to positive and negative power supply voltages and connected to a source and drain of said transistor to store the data signal as analog drive voltages of positive and negative polarities, respectively.

13. The display device according to claim 12, wherein said memory circuit includes a switch circuit which initially connects said first and second storage capacitances to power lines of the positive and negative polarities which supply the positive and negative power supply voltages, respectively, and then connects said first and second storage capacitances to the source and drain of said transistor, respectively.

14. The display device according to claim 13, wherein said memory circuit further includes an output circuit which outputs the analog drive voltages of the positive and negative polarities held by said first and second storage capacitances.

15. The display device according to claim 14, wherein said switch circuit includes a second transistor connected between said power line of the positive polarity and said first storage capacitance, a third transistor connected between said power line of the negative polarity and said second storage capacitance, a fourth transistor connected between the source of said first transistor and said first storage capacitance, a fifth transistor connected between said the drain of said first transistor and said second storage capacitance, said second and third transistors are controlled to temporarily turn on for setting said first and second storage capacitances to the positive and negative power supply voltages, respectively, and said fourth and fifth transistors are controlled to temporarily turn on, in place of said second and third transistors, for causing said first and second storage capacitances to store the data signal as the analog drive voltages of the positive and negative polarities, respectively.

16. The display device according to claim 15, wherein each of said scanning lines includes first subscanning lines of the positive and negative polarities which supply positive and negative pulses as a scanning signal to turn on said second and third transistors in one horizontal scanning period, and second subscanning lines of the positive and negative polarities, which supply positive and negative pulses as the scanning signal to turn on said fourth and fifth transistors in one horizontal scanning period next to said horizontal scanning period.

17. The display device according to claim 16, wherein said second subscanning lines of the positive and negative polarities are common to said first subscanning lines of the positive and negative polarities for the pixels in a next row.

18. The display device according to claim 16, wherein said first subscanning lines of the positive and negative polarities are connected as ground lines to said first and second storage capacitances of each of the memory circuits for the pixels in a next row.

19. The display device according to claim 15, wherein said output circuit includes sixth and seventh transistors whose gates are connected to said first and second storage capacitances, an eighth transistor connected at one end to said power line of the positive polarity via said sixth transistor and at the other end to a first load, and a ninth transistor connected at one end to said power line of the negative polarity via said seventh transistor and at the other end to a second load, and conduction of said eighth and ninth transistors are controlled.

20. The display device according to claim 19, wherein said first, third, fifth, seventh, and ninth transistors are P-channel transistors, and said second, fourth, sixth, and eighth transistors are N-channel transistors.

21. The display device according to claim 20, wherein the threshold voltages of said P-channel and N-channel transistors differ from each other in absolute value, said switch circuit further includes a tenth transistor connected between said first storage capacitance and said fourth transistor, said output circuit includes an eleventh transistor connected between said sixth and eighth transistors and a twelfth transistor connected between said seventh and ninth transistors, said tenth, eleventh, twelfth transistors are N-channel, P-channel, and N-channel transistors serving as voltage drop elements which compensate for a difference in the threshold voltages to provide the drive voltages of the positive and negative polarities equal in absolute value.

22. The display device according to claim 19, wherein each of said pixels has a structure that liquid crystal materials are held between a pair of electrodes, and said first and second loads are formed of a common one of said pixels.

23. The display device according to claim 13, wherein said switch circuit includes a pulse shaping circuit which inverts a gate pulse applied to one of the gates of said second and third transistors and supplied the inverted gate pulse to the other one of the gates of said second and third transistors.

* * * * *